US008901822B2

(12) United States Patent
Hartmann et al.

(10) Patent No.: US 8,901,822 B2
(45) Date of Patent: Dec. 2, 2014

(54) OPTICAL SIGNAL OUTPUT OF OPERATING PARAMETERS WITH AN LED LIGHTING UNIT

(75) Inventors: Martin Hartmann, Dombirn (AT); John Kears, Witton Gilbert Durham (GB)

(73) Assignee: Tridonic GmbH & Co KG, Hampshire (GB)

( * ) Notice: Subject to any disclaimer, the term of this patent is extended or adjusted under 35 U.S.C. 154(b) by 118 days.

(21) Appl. No.: 13/513,358

(22) PCT Filed: Dec. 3, 2010

(86) PCT No.: PCT/EP2010/068803

§ 371 (c)(1), (2), (4) Date: Jun. 22, 2012

(87) PCT Pub. No.: WO2011/067367

PCT Pub. Date: Jun. 9, 2011

(65) Prior Publication Data

US 2013/0043794 A1 Feb. 21, 2013

(30) Foreign Application Priority Data

| | | |
|---|---|---|
| Dec. 4, 2009 | (DE) | 10 2009 057 015 |
| Dec. 30, 2009 | (DE) | 10 2009 055 415 |
| Jan. 14, 2010 | (DE) | 10 2010 000 902 |

(51) Int. Cl.

| | |
|---|---|
| ***H01J 1/60*** | (2006.01) |
| ***H05B 37/02*** | (2006.01) |
| ***H05B 37/03*** | (2006.01) |

(52) U.S. Cl.

CPC ..... *H05B 37/0272* (2013.01); *H05B 37/034* (2013.01)

USPC ..... 315/129; 315/136; 315/294

(58) Field of Classification Search

CPC ..... H05B 33/0845; H05B 37/02; H05B 37/0227; H05B 37/0281; H05B 41/36

USPC ..... 315/86–87, 119, 127–129, 136, 291, 315/294, 307, 312

See application file for complete search history.

(56) References Cited

U.S. PATENT DOCUMENTS

| | | | | |
|---|---|---|---|---|
| 7,067,993 | B2 * | 6/2006 | Youle | 315/291 |
| 8,558,458 | B2 * | 10/2013 | Bae et al. | 315/86 |
| 2005/0133800 | A1 * | 6/2005 | Park et al. | 257/80 |
| 2008/0191628 | A1 * | 8/2008 | Marques et al. | 315/86 |
| 2009/0026978 | A1 | 1/2009 | Robinson | |

FOREIGN PATENT DOCUMENTS

WO 2006136236 A1 12/2006

OTHER PUBLICATIONS

International Search Report issued in connection with the corresponding International Patent Application No. PCT/EP2010/068803 on Jun. 14, 2011.

English translation of the International Preliminary Report on Patentability issued in connection with the corresponding international application No. PCT/EP2010/068803 on Jun. 14, 2012.

* cited by examiner

*Primary Examiner* — Tung X Le

(74) *Attorney, Agent, or Firm* — The H.T. Than Law Group

(57) ABSTRACT

The invention relates to a lighting arrangement with an operating device (3) and with an LED light source (4) which is controlled by said operating device and which is formed by at least two LEDs (4*a*, 4*b*, 4*c*), which emit light of different colors and together emit a white total light. The operating device (3) drives some of the LEDs (4*a*, 4*b*, 4*c*) forming the LED light source (4) which are intended to emit monochromatic (non-white) light in such a way that said LEDs emit light signals representing certain operating parameters.

23 Claims, 1 Drawing Sheet

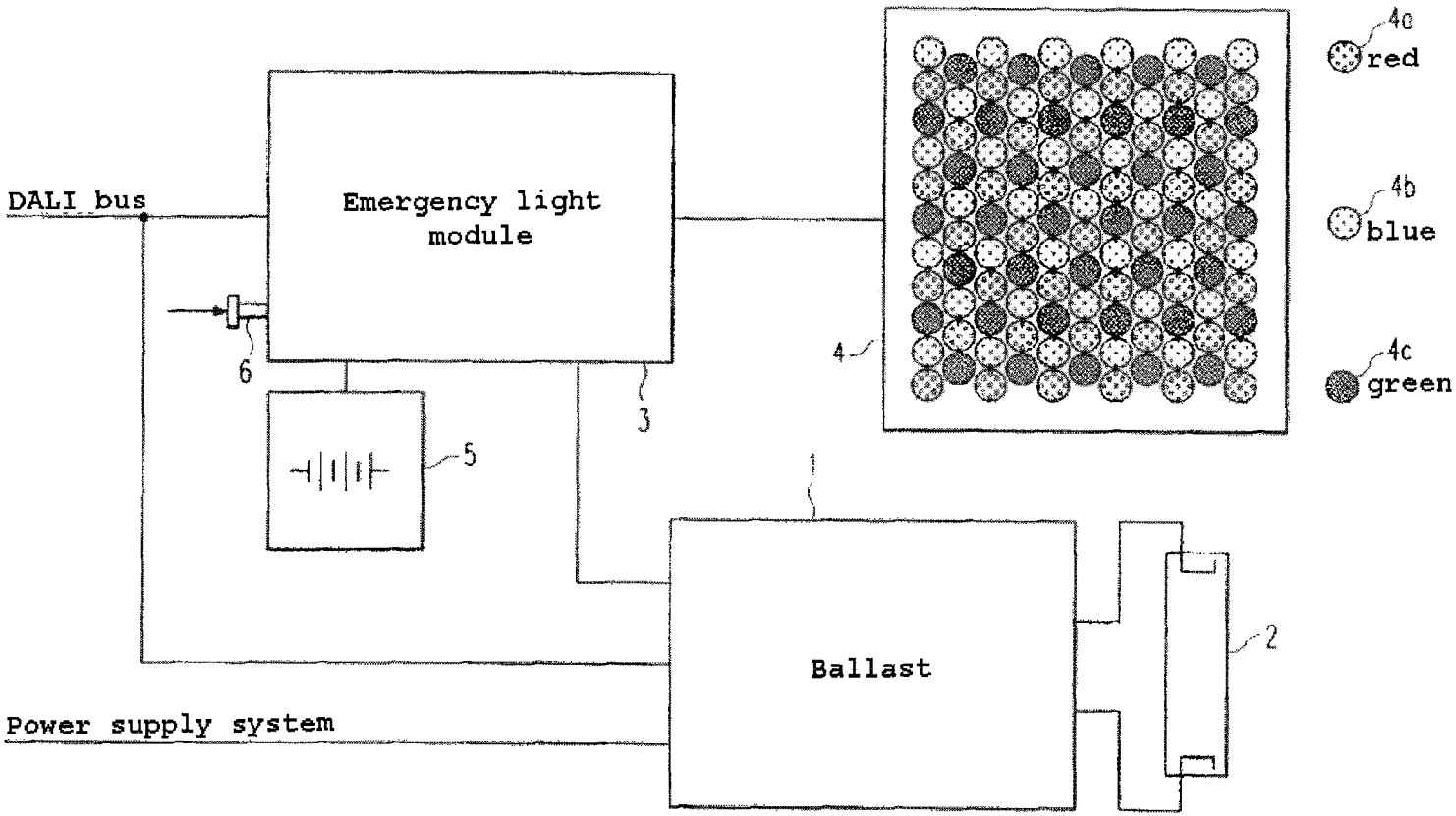
4a
red
4b
blue
4c
green
4
2
1
Ballast
3
Emergency light module
5
6
DALI bus
Power supply system

OPTICAL SIGNAL OUTPUT OF OPERATING PARAMETERS WITH AN LED LIGHTING UNIT

BACKGROUND OF THE INVENTION

The present invention relates to a method for the optical signal output of operating parameters in an operating device with an LED light source which is controlled by said operating device and is formed by at least two LEDs, which are intended individually to emit light of different colors and together to emit white total light.

Where it is mentioned below that an LED is "intended" to emit light of one color, this is intended to mean that the LED can only produce light of this color.

In the sector of lighting engineering and building services engineering, more or more systems have been developed in recent years in which various types of light-emitting means operating devices can be connected to one another via a bus system. One example of such a standardized bus system is the industry standard DALI.

When installing or modifying such a bus system, it is generally necessary to allocate an operating address to a newly added subscriber. This operating address can differ from an address of origin, possibly provided by the manufacturer, in the device.

It is known that the bus subscribers allocate the addresses themselves, for example on a random basis, from among a defined stock of addresses, triggered by a corresponding command from a bus control center. Since the bus address allocation to the bus subscribers is not the central focus of the present invention, reference is made to the relevant known methods.

In any case, an operating address will be assigned to each bus subscriber after completion of the method or each bus subscriber itself will have allocated itself an address from the defined stock of addresses. In order to be able to now proceed in targeted fashion with the following actual operation of the lighting installation controlled by means of the bus system, it is necessary to find out the operating address of each connected bus subscriber.

This requires a considerable amount of time since an operator needs to physically go up to each connected bus subscriber in order then to check the address allocation, usually visually, in situ. This installation step is naturally particularly laborious when the bus subscribers are distributed far apart in a building or possibly over several buildings. This is precisely the case with so-called emergency lighting devices, which are therefore intended to ensure defined emergency lighting, fed by a battery, in the event of failure of a system voltage supply and are generally distributed particularly far apart from one another over buildings. If, therefore, in particular in the case of emergency lighting devices, the fitter needs to move over wide areas of the installation area, at least finding the allocated addresses should then take place as quickly as possible.

WO 2006/136236 proceeds from this point and proposes providing additional optical and/or acoustic signal transducers which can reproduce the bus address in coded form, in addition to the light source controlled by the operating device. By way of example, LEDs which are preferably connected to the operating device can be used as acoustic signal transducers.

The present invention is intended to open up the possibility of reducing the hardware complexity involved in comparison with the most recently described prior art.

SUMMARY OF THE INVENTION

As a continuation of the method described at the outset in accordance with the characterizing part of independent claim 1, the solution consists in that some (i.e. a subgroup which comprises at least one but not all of the plurality of LEDs) of the LEDs forming the LED light source which are intended to emit monochromatic (non-white) light are driven for the optical signal output.

By virtue of the solution according to the invention, additional optical and/or acoustic signal transducers are superfluous. Instead, some of the LEDs forming the LED white light source perform the function of a signal output of information relating to specific operating parameters, such as the function state of an emergency light module or the original or operating address of the emergency light module, for example.

In addition, the invention relates to the use of an LED light source controlled by an operating device, the LED light source being formed by at least two LEDs which are intended individually to emit light of different colors and together to emit white total light for the signal output of operating parameters by virtue of some of the LEDs forming the LED light source which are intended to emit monochromatic (non-white) light being driven for the optical signal output.

Finally, the invention relates to a lighting arrangement with an operating device and with an LED light source which is controlled by said operating device and which is formed by at least two LEDs, which emit light of different colors and together emit a white total light. The operating device is characterized by the fact that some (i.e. a subgroup which comprises at least one, but not all of the plurality of LEDs) of the LEDs forming the LED light source which are intended to emit monochromatic (non-white) light are driven in such a way that said LEDs emit light signals representing specific operating parameters.

The invention relating to the use and the invention relating to the lighting arrangement are based on the same object and the same solution principle as the invention relating to the method described at the outset. Therefore, reference is made to the corresponding embodiments in order to avoid repetition.

The last-mentioned dependent claims are intended to be included fully in the disclosure content of the description, likewise in order to avoid unnecessary repetition. Nevertheless, some particularly important configurations will be commented on briefly below again.

For example, the LEDs selected for signal output should be intended for emitting a selected color, but they do not need to and also cannot emit a non-monochromatic secondary color. It is essential that the selected LEDs emit a non-white total light which differs in terms of its color clearly from the white light which is intended to be emitted by the LED light source, as intended, for lighting the surrounding environment thereof.

Expediently, the LED light source should comprise a large number of groups, each having at least two LEDs, which are intended to emit a light of different colors and together to emit white total light. The LEDs selected for the signal output then form at least one subgroup.

Each group of LEDs can comprise a white light LED and an LED supplementing the color spectrum thereof, which is intended to emit monochromatic light. A subgroup selected for the signal output then comprises LEDs intended for emitting monochromatic light.

The white light LEDs are preferably dye-converted LEDs, for example LEDs with at least two dyes. The LEDs supplementing the color spectrum can be those which are intended to emit red light, for example.

As an alternative to this, each group can comprise three LEDs, of which a first LED is intended to emit red light, a second LED is intended to emit green light and a third LED is intended to emit blue light.

A further possibility is for at least one LED which is intended to emit monochromatic light to be caused to flash for the signal output.

For the case in which the operating parameter to be indicated is intended to be a self-test result of the operating device, a positive result can be realized by at least one LED which is intended to emit green light flashing, for example, while a negative result (defective state) can be realized by at least one LED which is intended to emit red light flashing.

A further possibility consists in at least one LED which is intended to emit monochromatic light being driven in such a way that it transmits information by illuminating for short and long periods of time, for example using Morse code.

It is likewise possible for at least one LED which is intended to emit monochromatic light to be driven in such a way that the signal output produced by this LED flashing takes place in binary-coded or decimal-coded form.

Another variant can consist in that the LEDs which are intended to emit colored light and form a subgroup are driven in such a way that they represent numbers, digits or other symbols, by means of which the signal output is realized.

The inventions are particularly suitable for indicating an address of origin or an operating address of an operating device for the LED light source or another light source. The operating device can be called up from a remote control center, possibly via a bus system, for signal transmission via the mentioned address.

The invention also relates to a lighting system having at least two lighting arrangements, which are driven via a bus line, for example in accordance with the DALI standard, and are preferably connected to a central unit.

In this case, it can be possible for an individual and/or a group address to be assigned to each lighting arrangement, the light signals representing specific operating parameters reproducing the assigned address of the associated lighting arrangement.

In this case, different addresses can be reproduced by light signals of different spectrums, in particular different colors.

It can be possible for the output of the assigned address by means of the light signals to be triggered by a command from the central unit or by a manual user action.

One exemplary embodiment relating to the abovementioned inventions will be explained below with reference to the single FIGURE.

BRIEF DESCRIPTION OF THE DRAWINGS

The single FIGURE shows a lighting arrangement with a gas discharge lamp, a ballast therefor and an emergency light module with LED light source, all controlled from a control center (not illustrated) via a bus system.

DETAILED DESCRIPTION OF THE INVENTION

The single FIGURE shows an electronic ballast, which controls a gas discharge lamp 2 for lighting a space which is not specified in any more detail. The ballast 1 draws its electrical energy from the power supply system.

When the system voltage supply fails, an emergency light module 3 fed by a battery 5 becomes active and brings an LED light source 4 into operation. The latter is particularly well suited for the emergency lighting operation since, in contrast to the gas discharge lamp 2, it can be operated on a low voltage, with the result that there are no conversion losses. In addition, the energy efficiency of the LED light source 4 is more favorable than that of the gas discharge lamp 2, which is an important factor during battery operation.

The emergency light module 3 likewise has bus capability, in the same way as the ballast 2, by virtue of it having an interface for a digital data bus, to which a data bus in accordance with the DALI standard, which is well known from the prior art, can be connected, for example. A single-wire bus or else a multiple-wire bus can be provided.

The DALI standard naturally only represents one example of the protocol used. Other digital or else analog protocols can be used.

The LED light source 4 can also take on the lighting function of the gas discharge lamp 2 given corresponding dimensioning and when permissible in respect of boundary conditions. This means that, in this case, the gas discharge lamp 2 and the ballast can be dispensed with. The LED light source is then therefore used both for the signal output and also for lighting purposes. The emergency light module 3 is then configured in such a way that it can also be operated on the power supply system and is only switched over to battery operation in the event of system failure. In this variant, the advantage associated with the inventions is fully apparent. It consists in that the LED light source 4 is designed not only for general lighting of the surrounding environment, but also for the local optical signal output of operating parameters of which knowledge is desired or required in situ.

Such an operating parameter can be, for example, the result of a self-test of the emergency light module 3 which can be initiated by a pushbutton 6 provided on the emergency light module 3 being depressed. The self-test can relate to the state of the battery of the emergency light module, for example.

In principle, the optically output operating parameters can indicate operating states and/or faults of the light source. For this purpose, a self-test can be implemented in advance by the operating device, with it being possible for this self-test to be triggered by internal control means and/or by external signals One example of a fault indication is the event of a limit value being exceeded and/or undershot by the (system) supply voltage.

Furthermore, operating data, such as the number or the duration of the operation of the light source or component-part ageing, for example, can be indicated. These parameters can be determined by means of a counter and/or by means of measurement circuit determining these parameters, it being possible for the measurement circuit to implement a monitoring measurement.

The LED light source 4 is a white light source. In the present example, it comprises three groups of LEDs. The LEDs 4*a* in the first group are intended to emit red light. The LEDs 4*b* in the second group are intended to emit blue light. The LEDs 4*c* in the third group are intended to emit green light. When the LEDs 4*a*, 4*b*, 4*c* in all three groups are driven to emit light by the emergency light module 3, the total light emitted by said LEDs is white, as intended.

There are now various possibilities for indicating the abovementioned operating parameters, but all of these possibilities have the common feature that no additional means are required for the signal output, as is still the case in the prior art (for example WO 2006/136236).

In the present case, the indication of the operating parameters takes place by virtue of only some of the LEDs of the LED light source being driven for the optical signal output in such a way that said LEDs, in contrast to regular lighting, emit monochromatic light or else a total mixed light which is not white.

In order to indicate a positive self-test result of the emergency light module 3, one or more LEDs 4*c* which are intended to emit a monochromatic green light can be driven, for example. In order to indicate a negative self-test result (fault), on the other hand, one or more LEDs 4*a* which are intended to emit red light can be driven.

An address can be transmitted by virtue of the fact that one or more selected LEDs which are intended to emit one of the three colors is/are driven in such a way that it/they flash(es). The flashing can take place in short or long light-emitting phases, with the result that the information can be transmitted, for example using Morse code.

However, it is also possible to output the information in binary-coded or decimal-coded form.

Finally, it is also possible to represent the desired operating parameter directly in the form of digits, numbers or other symbols by virtue of the corresponding LEDs in the LED light source being driven taking into consideration the main rule that no total light should be generated which can be confused with the white light which is provided for general lighting.

Instead of generating white light by a triplet of LEDs 4*a*, 4*b*, 4*c* which are intended to emit red, blue and green light, it is also possible for the LED light source to comprise only two groups of LEDs, of which one comprises dye-converted white-light LEDs and the other comprises LEDs which are intended to emit monochromatic red light and supplement the color spectrum of the white-light LEDs in such a way that a white total light is generated which comes closer to the requirements for interior lighting than the white light emitted only by the white-light LEDs. Since white light is not monochromatic, there are many variants of this. It is important in this context that the LEDs which are intended to emit red light are driven for the signal output.

The invention claimed is:

1. A method for the optical signal output of operating parameters in an operating device (3) with an LED light source (4) which is controlled by said operating device and is formed by at least two non-white LEDs (4*a*, 4*b*, 4*c*), which individually are configured to emit non-white light of different colors and together provide lighting by emitting white total light, wherein the method comprises the steps of:

selecting one or more of the non-white LEDs (4*a*, 4*b*, 4*c*) forming the LED light source (4) that are configured to emit the non-white light; and driving these one or more selected non-white LEDs to provide a diagnostic optical signal output comprising emitted non-white light indicating operating parameters of the operating device.

2. The method as claimed in claim 1, the operating parameters being selected from the following:

fault states in respect of the supply voltage, voltages at a component part of the operating device, and/or number and/or duration of the operation of the operating device.

3. The method as claimed in claim 2, wherein the voltages comprise a battery voltage.

4. The method as claimed in claim 1, wherein the LED light source (4) comprises a large number of groups, each having at least two LEDs (4*a*, 4*b*, 4*c*), which are configured to emit light of different colors and together to emit white total light, and in that LEDs, forming at least one subgroup, which are configured to emit light of a specific color are driven to provide the diagnostic optical signal output by virtue of light emission.

5. The method as claimed in claim 4, wherein each group of LEDs comprises a white light LED and an LED supplementing the color spectrum thereof which is configured to emit monochromatic light, and in that a subgroup which comprises LEDs configured to emit monochromatic light is driven to provide the diagnostic optical signal output by virtue of light emission.

6. The method as claimed in claim 5, wherein the white light LEDs are dye-converted LEDs.

7. The method as claimed in claim 6, wherein the white light dye-converted LEDs are LEDs converted with at least two dyes.

8. The method as claimed in claim 4, wherein each group comprises three LEDs (4*a*, 4*b*, 4*c*), of which a first LED (4*a*) is configured to emit red light, a second LED (4*c*) is configured to emit green light and a third LED (4*b*) is configured to emit blue light.

9. The method as claimed in claim 1, wherein the diagnostic optical signal output is implemented by clocked modulation of at least one LED (4*a*, 4*b*, 4*c*), which is configured to emit monochromatic light.

10. The method as claimed in claim 9, wherein a positive result of a self-test of the operating device (3) is realized by at least one LED (4*c*) which is configured to emit green light flashing, and in that a negative result is realized by at least one LED (4*a*) which is configured to emit red light flashing.

11. The method as claimed in claim 10, wherein the negative result corresponds to a defective state of the operating device.

12. The method as claimed in claim 9, wherein the diagnostic optical signal output is an address of origin or an operating address, via which the operating device (3) is configured to be called up from a remote control center, via a bus system, for signal transmission.

13. The method as claimed in claim 1, wherein the lighting is emergency lighting.

14. The method as claimed in claim 1, wherein at least one of the operating parameters of the operating device has a corresponding diagnostic optical signal output consisting of non-white light of a selected color.

15. A lighting arrangement provided with an operating device (3) and with an LED light source (4) which is controlled by said operating device and which is formed by at least two LEDs (4*a*, 4*b*, 4*c*), which emit light of different colors and together provide lighting by emitting a white total light, wherein the operating device (3) drives some of the LEDs (4*a*, 4*b*, 4*c*) forming the LED light source (4) which are configured to emit monochromatic tight in such a way that said driven LEDs emit diagnostic light signals comprising emitted monochromatic light representing certain operating parameters of the operating device (3).

16. The lighting arrangement as claimed in claim 15, wherein the light source (4) comprises a large number of groups, each having at least two LEDs (4*a*, 4*b*, 4*c*), which are configured to emit light of different colors and together to emit white total tight, and in that LEDs, forming at least one subgroup, which are configured to emit light of a specific color are driven by the operating device to provide diagnostic light signal output by virtue of light emission.

17. The lighting arrangement as claimed in claim 16, wherein each group of LEDs comprises a white light LED and an LED supplementing the color spectrum thereof which is configured to emit monochromatic light, and in that a subgroup which comprises LEDs configured to emit monochromatic tight is driven by the operating device (3) to provide diagnostic light signal output by virtue of light emission.

18. A lighting system having at least two lighting arrangements, wherein each lighting arrangement is a lighting arrangement as claimed in claim 15, which are driven via a bus line in accordance with the DALI standard, and are connected to a central unit.

19. The lighting system as claimed in claim 18, wherein an individual and/or a group address is assigned to each lighting arrangement, and the light signals representing specific operating parameters reproduce the assigned address of the associated lighting arrangement.

20. The lighting system as claimed in claim 19, wherein different addresses are reproduced by light signals of different spectrums comprising different colors.

21. The lighting system as claimed in claim 20, in which the output of the assigned address by means of the light signals is triggered by a command from the central unit or by a manual user action.

22. The lighting arrangement as claimed in claim 15, wherein at least one of the operating parameters of the operating device has a corresponding diagnostic light signal consisting of monochromatic light of a selected color.

23. The lighting arrangement as claimed in claim 15, further comprising a pushbutton disposed to initiate a self-test of the operating device (3) when depressed.

* * * * *